US009982411B2

(12) United States Patent
Haskins

(10) Patent No.: US 9,982,411 B2
(45) Date of Patent: May 29, 2018

(54) MANHOLE COVER SAFETY APPARATUS

(71) Applicant: Manhole Safety Covers, LLC, Scottsdale, AZ (US)

(72) Inventor: Jeremy Haskins, Scottsdale, AZ (US)

(73) Assignee: Manhole Safety Covers, LLC, Scottsdale, AZ (US)

( * ) Notice: Subject to any disclaimer, the term of this patent is extended or adjusted under 35 U.S.C. 154(b) by 0 days. days.

(21) Appl. No.: 15/266,993

(22) Filed: Sep. 15, 2016

(65) Prior Publication Data

US 2017/0089027 A1 Mar. 30, 2017

Related U.S. Application Data

(60) Provisional application No. 62/233,058, filed on Sep. 25, 2015.

(51) Int. Cl.

| | |
|---|---|
| ***E02D 29/14*** | (2006.01) |
| ***E02D 29/12*** | (2006.01) |
| ***B65H 57/14*** | (2006.01) |

(52) U.S. Cl.

CPC ..... *E02D 29/127* (2013.01); *B65H 57/14* (2013.01); *E02D 29/14* (2013.01); *B65H 2701/36* (2013.01)

(58) Field of Classification Search

CPC ..... E02D 29/127; E02D 29/14; B65H 57/14; B65H 2701/36

USPC ..... 52/20

See application file for complete search history.

(56) References Cited

U.S. PATENT DOCUMENTS 2,142,851 A * 1/1939 Jolly ..... E04H 15/003 135/118
2,627,865 A * 2/1953 Mitchell ..... B60J 11/00 135/117
2,797,696 A * 7/1957 Fritsche ..... E04H 15/38 135/117
3,106,986 A * 10/1963 Ray ..... E06C 7/185 182/106
3,190,300 A * 6/1965 Wear ..... E04H 15/003 135/126
3,235,215 A 2/1966 Lodde, Jr.
3,525,290 A * 8/1970 Pelsue ..... E04H 15/04 135/126
3,621,623 A 11/1971 Downes
3,810,482 A * 5/1974 Beavers ..... E04H 15/48 135/147
4,116,206 A * 9/1978 Warner ..... E04B 1/3211 135/133
4,838,294 A * 6/1989 Hunt ..... E04H 6/44 135/124
5,842,495 A * 12/1998 Egnew ..... E04H 15/38 135/114

(Continued)

*Primary Examiner* — Jerry E Redman

(74) *Attorney, Agent, or Firm* — Polsinelli PC; Ari M. Bai

(57) ABSTRACT

Embodiments of a manhole cover safety apparatus having a circular base defining a central opening and a flange that extends outwardly from the circular base. An expandable cover is in rotatable engagement with the flange through a plurality of frame members that are secured to a cover portion which is operable between a deployed position wherein the cover portion covers at least a portion of the circular opening to provide a visual and physical warning of an uncovered manhole and a retracted position wherein the cover portion does not cover the central opening.

16 Claims, 7 Drawing Sheets

(56) References Cited

U.S. PATENT DOCUMENTS

| | | | | |
|---|---|---|---|---|
| 6,892,897 | B2 * | 5/2005 | Stewart | B65D 33/02 220/213 |
| 6,994,489 | B1 | 2/2006 | Corr | |
| 7,475,700 | B2 * | 1/2009 | Pollard | E04H 15/38 135/132 |
| 7,862,257 | B2 | 1/2011 | Jeong et al. | |
| 7,926,500 | B2 * | 4/2011 | Perez | A47D 15/003 135/125 |
| 8,109,403 | B2 | 2/2012 | Michel | |
| 8,418,708 | B2 * | 4/2013 | Benish | E04H 15/38 135/88.07 |
| 8,726,577 | B2 * | 5/2014 | Whiting | E04D 13/0335 256/25 |
| 9,238,924 | B2 * | 1/2016 | Wyant | E04H 15/001 |
| 9,347,237 | B2 * | 5/2016 | Ponciano | E04H 15/001 |
| 9,366,054 | B2 * | 6/2016 | Li | E04H 15/48 |
| 9,598,876 | B1 * | 3/2017 | LaHood | E04H 15/58 |
| 9,637,885 | B2 * | 5/2017 | Lokkinen | E01F 13/02 |
| 9,752,345 | B1 * | 9/2017 | LaHood | E04H 15/18 |
| 2010/0299999 | A1 * | 12/2010 | Pizzolato | E02D 29/12 49/380 |
| 2015/0104254 | A1 | 4/2015 | Minarovic | |

* cited by examiner

MANHOLE COVER SAFETY APPARATUS

CROSS REFERENCE TO RELATED APPLICATIONS

This is a non-provisional application that claims benefit to U.S. provisional application Ser. No. 62/233,058 filed on Sep. 25, 2015, which is herein incorporated by reference in its entirety.

FIELD

The present disclosure relates to a safety apparatus, and in particular to a safety apparatus used in covering manhole covers.

BACKGROUND

Manhole cover safety apparatuses are well known for providing a warning to individuals that a manhole is uncovered. As shown in FIG. 10, a typical manhole cover safety apparatuses range from emergency cones 10 that may be stationed adjacent the manhole 8 to provide a visual warning to more sophisticated manhole safety apparatuses 12 that are secured around the opening of the manhole 8 to prevent accidental entry into an uncovered manhole 8, while still allowing access through the opening of the manhole 8. Although conventional manhole cover safety apparatuses work well for their intended purposes, there lacks a manhole cover safety apparatus that is secured to the opening of the manhole which allows cables and other equipment to easily pass through the opening of the manhole. As such, there is a need for further improvements in manhole cover safety apparatuses that, among other things, provide a raised visual deterrent and accidental fall protection for manholes.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
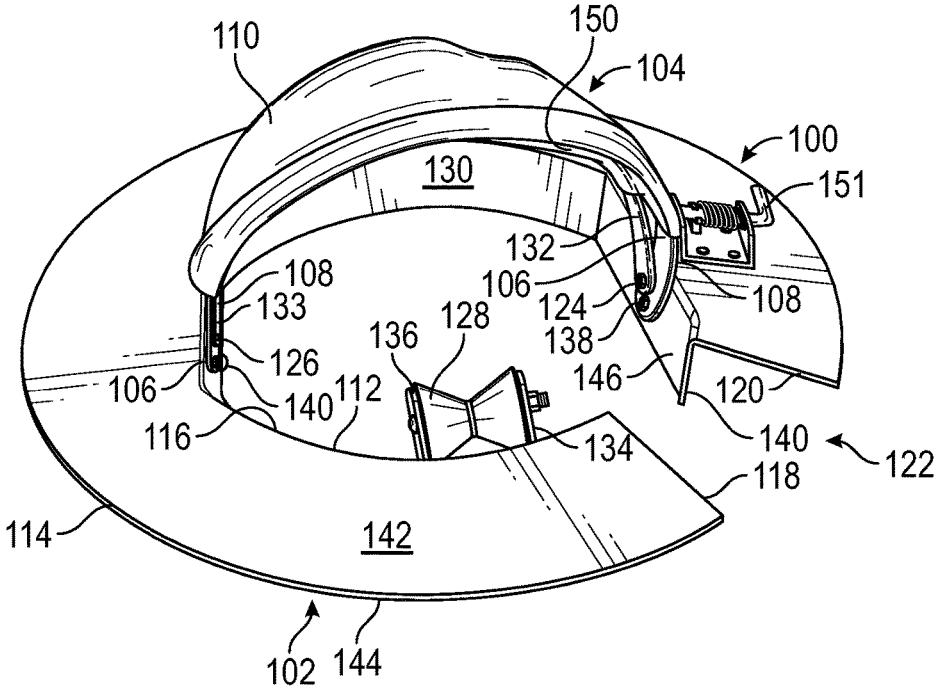
FIG. 1 is a perspective view of one embodiment of a manhole cover safety apparatus with the expandable cover in the deployed position.
Figure 2:
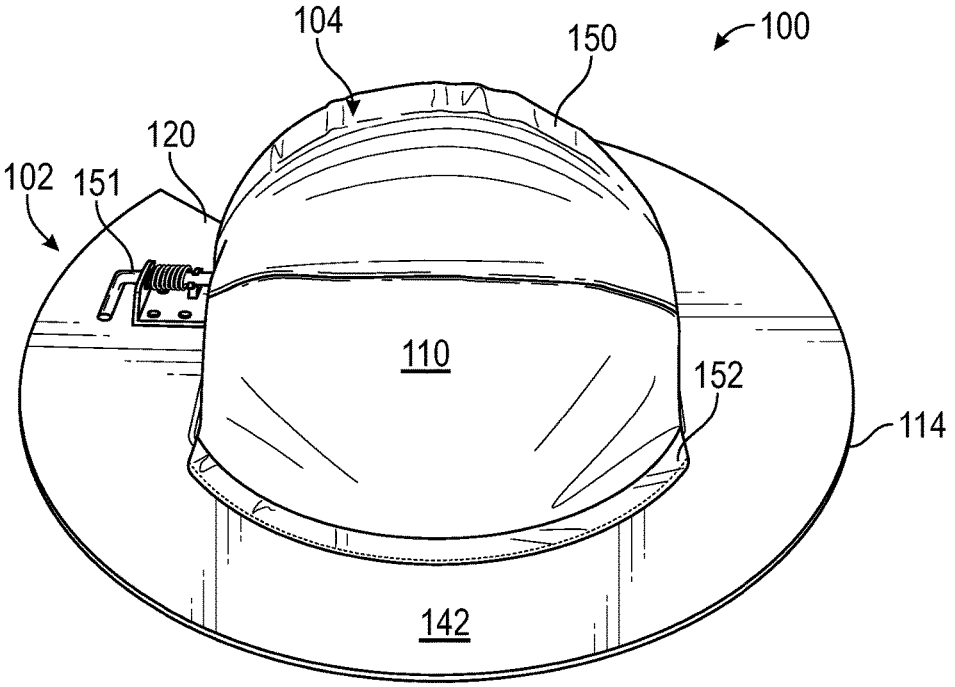
FIG. 2 is a top view of the manhole cover safety apparatus with the expandable cover in the deployed position.
Figure 3:
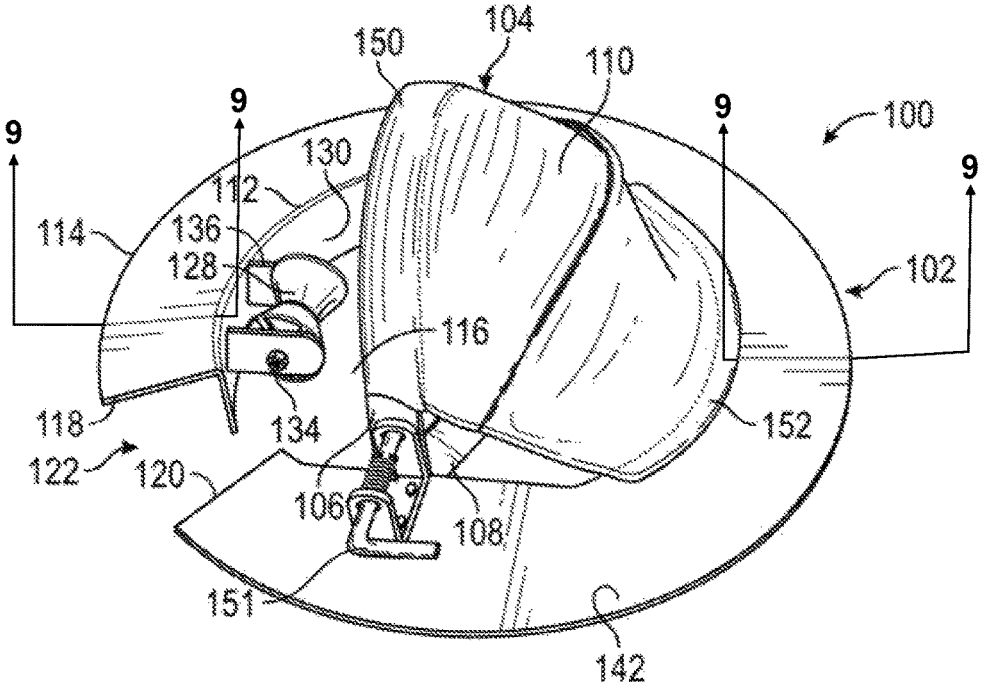
FIG. 3 is a side view of the manhole cover safety apparatus with the expandable cover in the deployed position.

Various embodiments for a manhole cover safety apparatus having a circular base configured to be coupled to the opening of a manhole for providing both a visual warning of an uncovered manhole and prevent accidental entry into the manhole are disclosed. The manhole cover safety apparatus includes an expandable cover that is operable between a deployed position in which the opening of the manhole is at least partially closed to entry and a retracted position in which the opening of the manhole is substantially open to entry. In addition, the manhole cover safety apparatus includes a roller for facilitating the entry of cables and other equipment through the manhole. Referring to the drawings, embodiments of the manhole cover safety apparatus illustrated and generally indicated as 100 in FIGS. 1-9.

Figure 9:
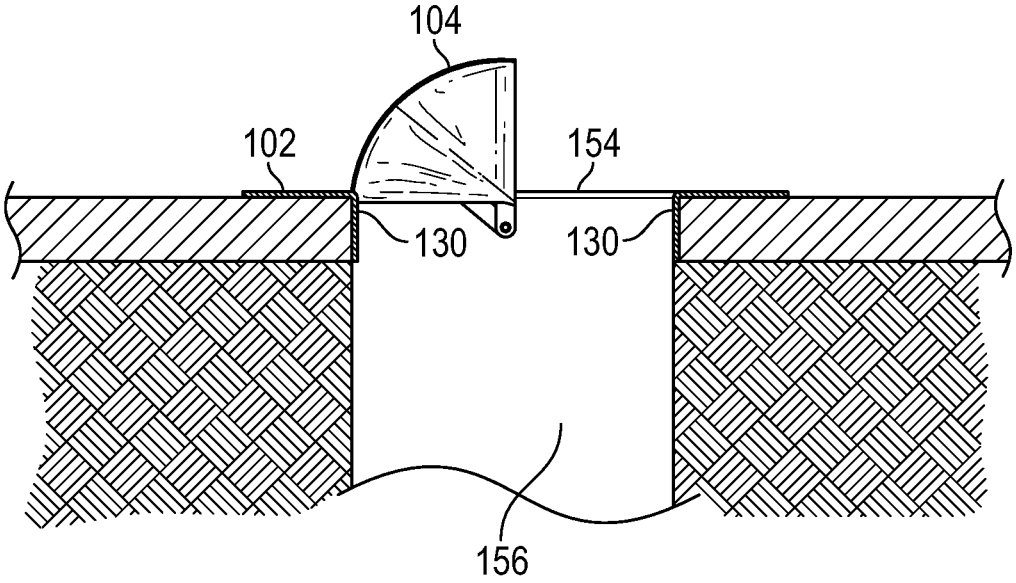
FIG. 9 is a simplified illustration that shows the manhole cover safety apparatus secured to the opening of the manhole with the expandable cover in the deployed position.
Figure 10:
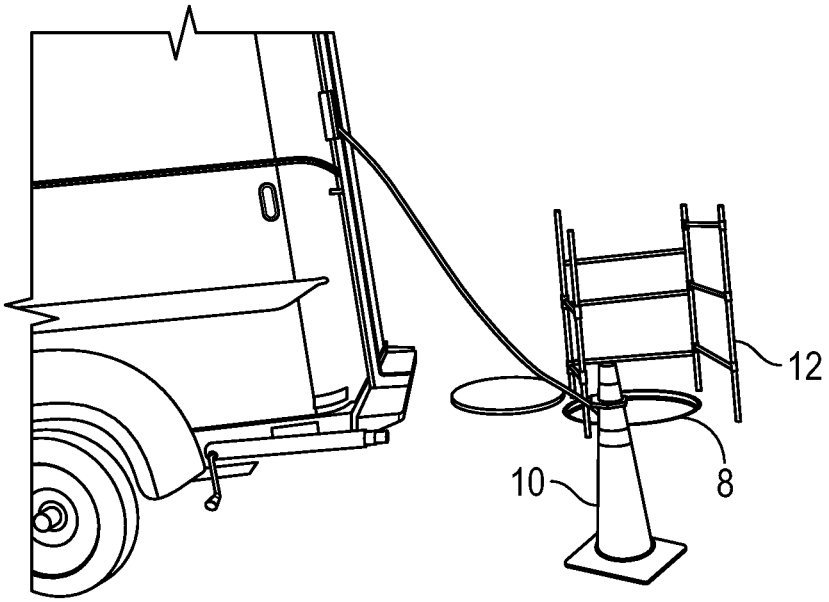
FIG. 10 (Prior Art)
FIG. 10 is an illustration of a prior art manhole cover safety apparatus.
Figure 11:
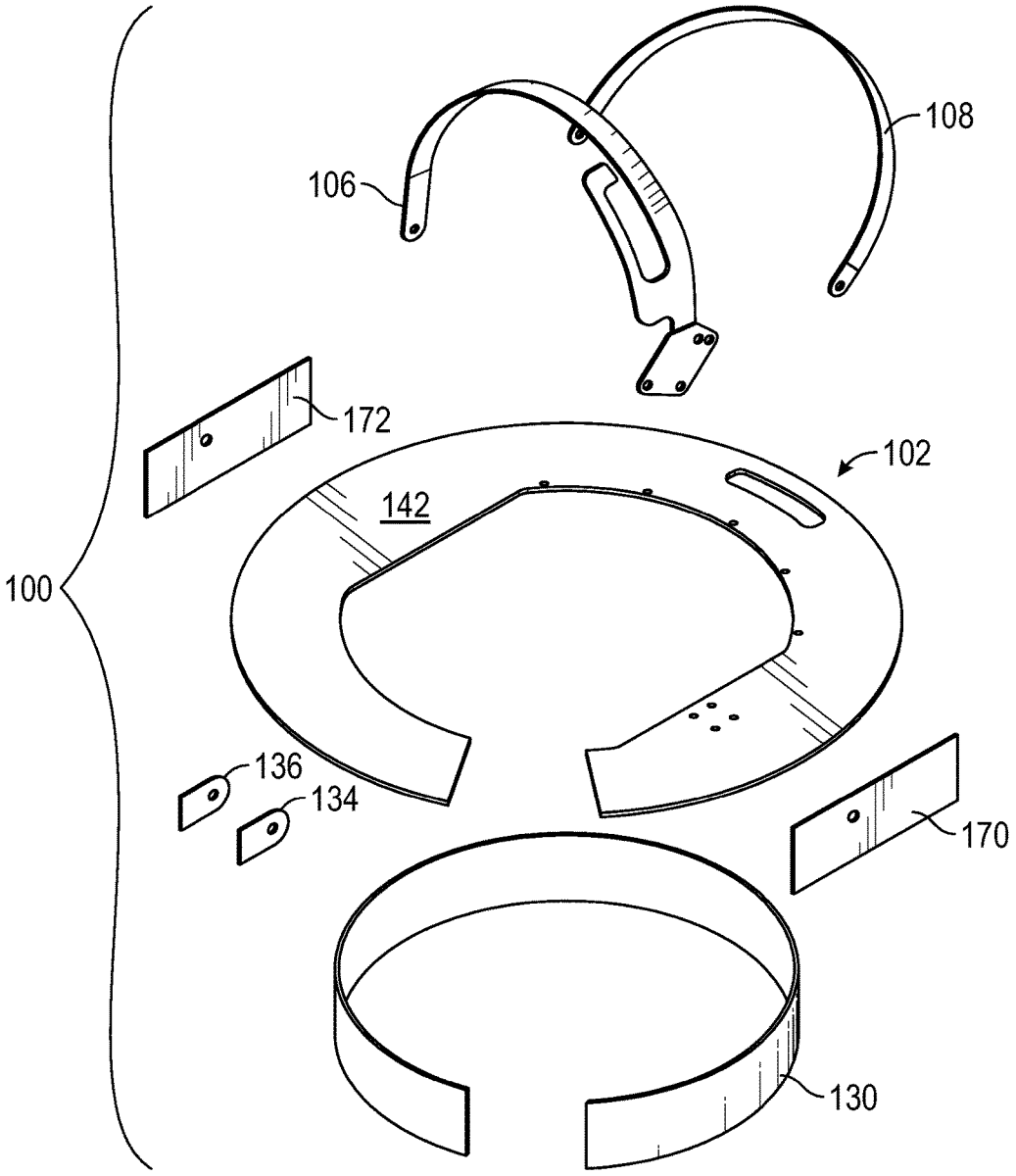
FIG. 11 is an exploded view of the manhole cover safety apparatus shown without the expandable cover.
Figure 12:
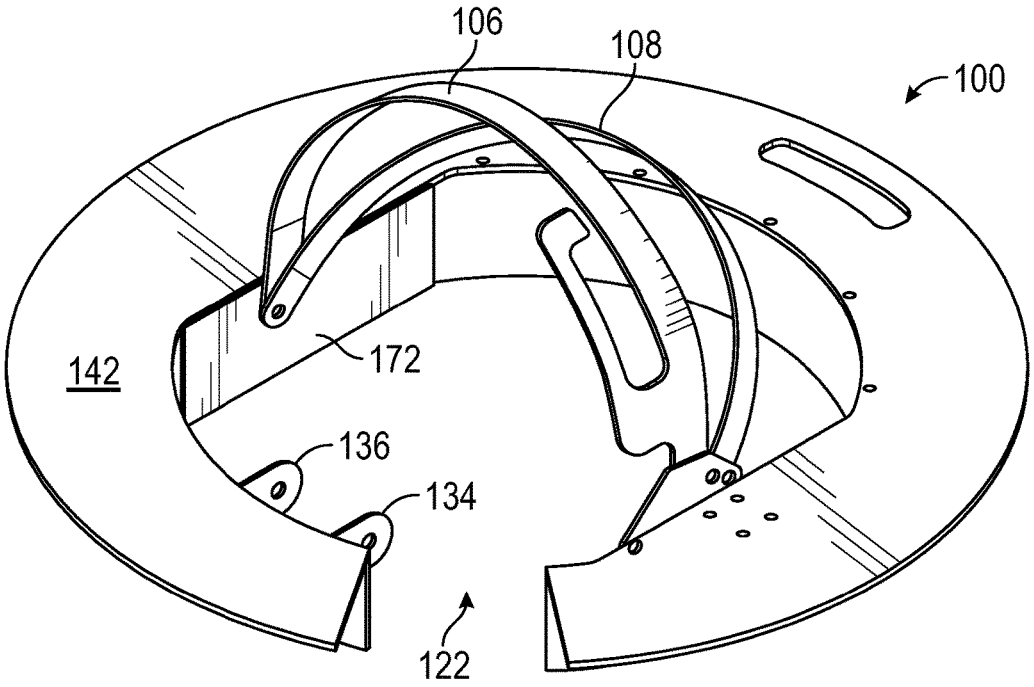
FIG. 12 is a perspective view of the manhole cover safety apparatus shown without the expandable cover.
Figure 13:
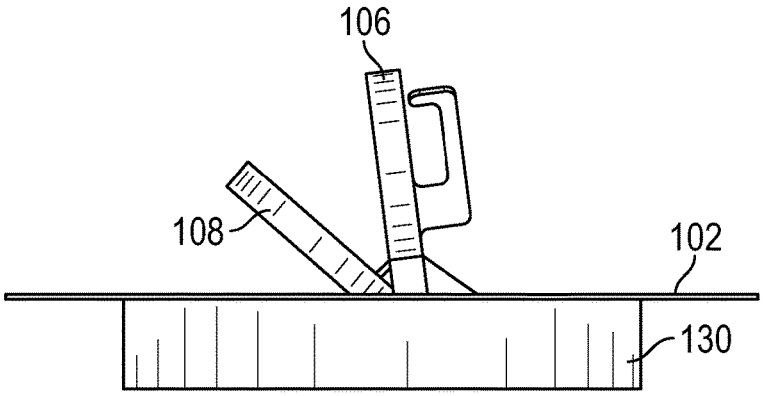
FIG. 13 is a side view of the manhole cover safety apparatus shown without the expandable cover.

Referring to FIGS. 1-3 and 11-13, the manhole cover safety apparatus 100 includes a circular base 102 defining an outer circumferential edge 114 and an inner circumferential edge 112, which defines a generally circular opening 116 that is substantially covered and uncovered by an expandable cover 104. The circular base 102 defines an upper surface 142 and a lower surface 144. In addition, the circular base 102 includes a flange 130 that extends downwardly from the circular base 102 and is configured to abut the lip of the manhole opening 156 defined by manhole 154 when the manhole cover safety apparatus 100 is engaged to the manhole 154 as shown in FIG. 9. As further shown in FIG. 1, the flange 130 defines an inner surface 146 that is exposed when the circular base 102 is in contact with the manhole 154 and an outer surface 148 that is hidden when the circular base 102 is in contact with the manhole.

In some embodiments, the circular base 102 may form a first end portion 118 and a second end portion 120 that collectively define a slot 122, which communicates with the circular opening 116 formed by the circular base 102. The slot 122 is configured to allow access through the manhole 154 when the manhole cover safety apparatus 100 is secured to the manhole opening 156. In other embodiments, the circular base 102 of the manhole cover safety apparatus 100 may lack any type of slot 122 and may have a complete circular configuration.

In some embodiments, the expandable cover 104 includes a cover portion 110 that is operable between a deployed position (FIGS. 1-3) in which the cover portion 110 at least partially covers the opening of the manhole and a retracted position (FIGS. 4-6) when the cover portion 110 substantially uncovers the opening of the manhole. In some embodiments, the cover portion 110 is secured to a first frame member 106 and a second frame member 108 that are both in rotatable engagement with the flange 130 such that the first and second frame members 106 and 108 may be rotated between the deployed position and the retracted position. In other embodiments, the expandable cover 104 may include three or more frame members that are rotatable between the deployed and retracted positions. In some embodiments, a handle 151 is operatively engaged to the expandable cover 104 to position the cover portion 110 between deployed and retracted positions when the handle is actuated. For example, in some embodiments actuating the handle 151 in one direction causes the cover portion 110 to be placed in the deployed position and actuating the handle 151 in an opposite direction causes the cover portion to be placed in the retracted position.

Referring to FIGS. 1, and 3-5, in some embodiments the first frame member 106 may be secured to the front part 150 of the cover portion 110 and the second frame member 108 may be secured along another part of the cover portion 104 between the front and back parts 150 and 152. In other embodiments, additional rotatable frame members may be secured to other parts of the cover portion 110 to provide further structural integrity to the expandable cover 104. In some embodiments, the back part 152 of the cover portion 110 may be secured to the upper surface 142 of the circular base 102. In some embodiments, the cover portion 110 may be made from a flexible fabric and may have a distinctive color, such as a green and/or orange glow color. In some embodiments, the cover portion 110 may define an inner fabric and an outer fabric that collectively define a space there between such that the first and second frame members 106 and 108 may be inserted into the space and in contact with the inner and/or outer fabric of the cover portion 110. In some embodiments, the cover portion 110 may define internal sleeves each configured to receive the first and second frame members 106 and 108, respectively.

Figure 4:
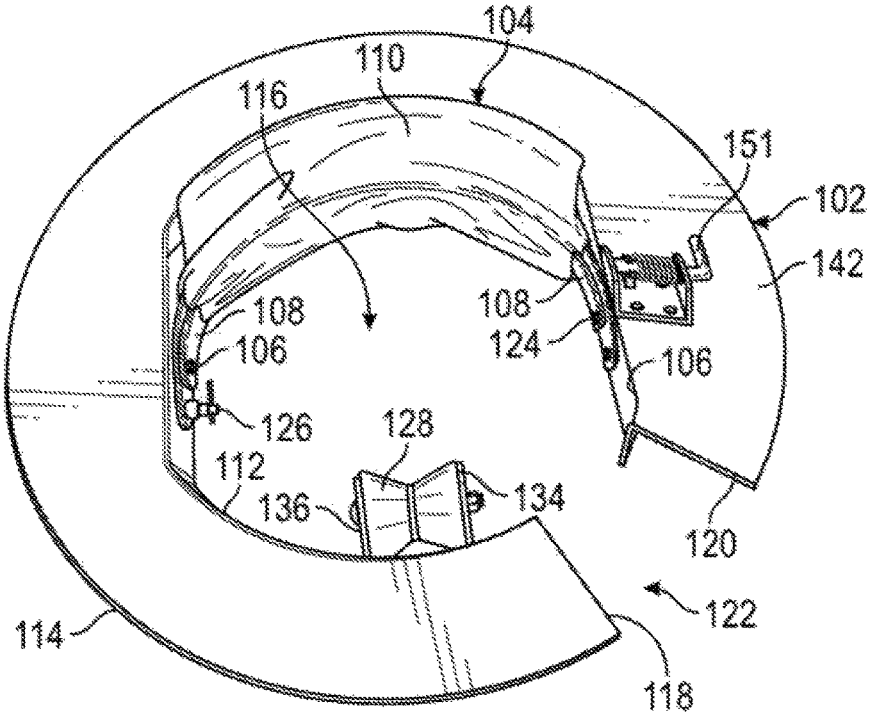
FIG. 4 is a perspective view of the manhole cover safety apparatus with the expandable cover in the retracted position.
Figure 5:
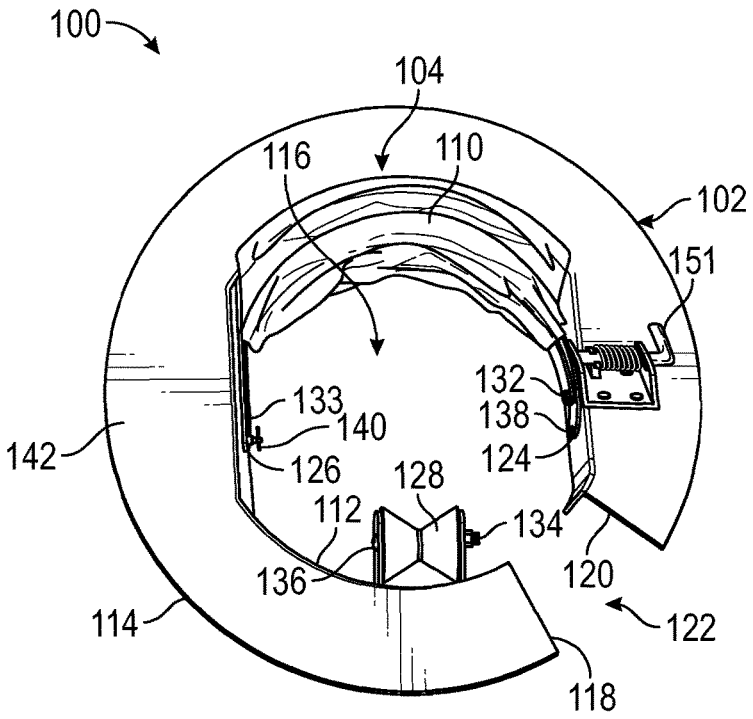
FIG. 5 is a top view of the manhole cover safety apparatus with the expandable cover in the retracted position.
Figure 6:
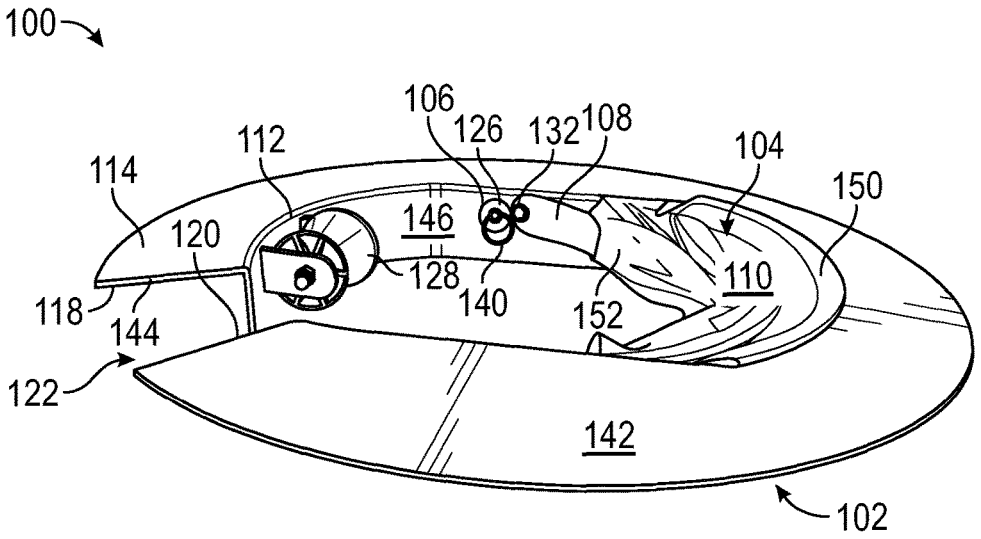
FIG. 6 is a side view of the manhole cover safety apparatus with the expandable cover in the retracted position.
Figure 7:
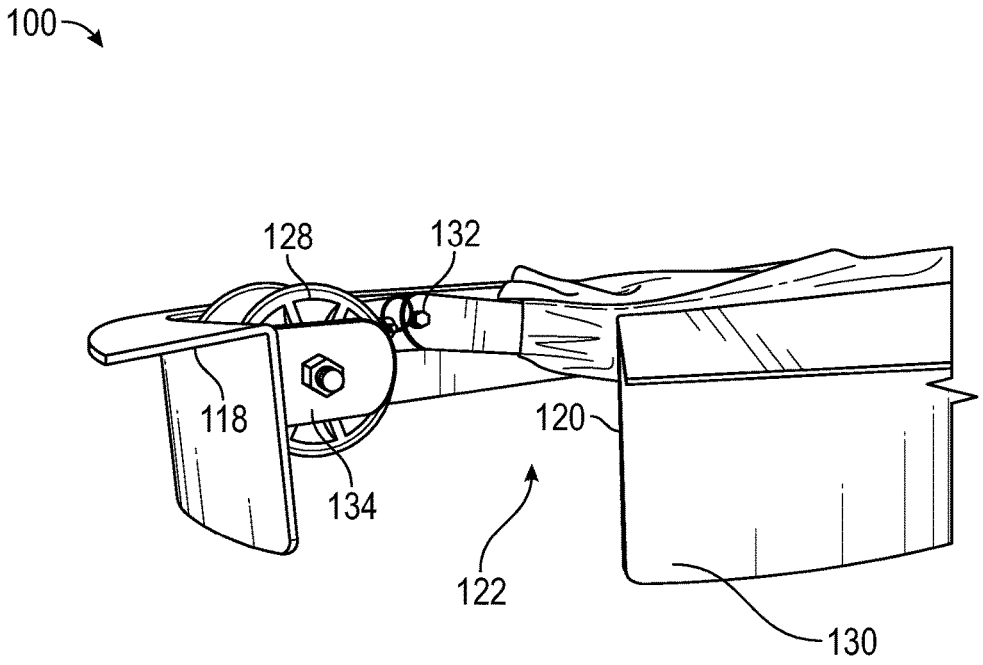
FIG. 7 is an enlarged view of the manhole cover safety apparatus showing a roller used to facilitate the entry of cables through the opening of the manhole.
Figure 8:
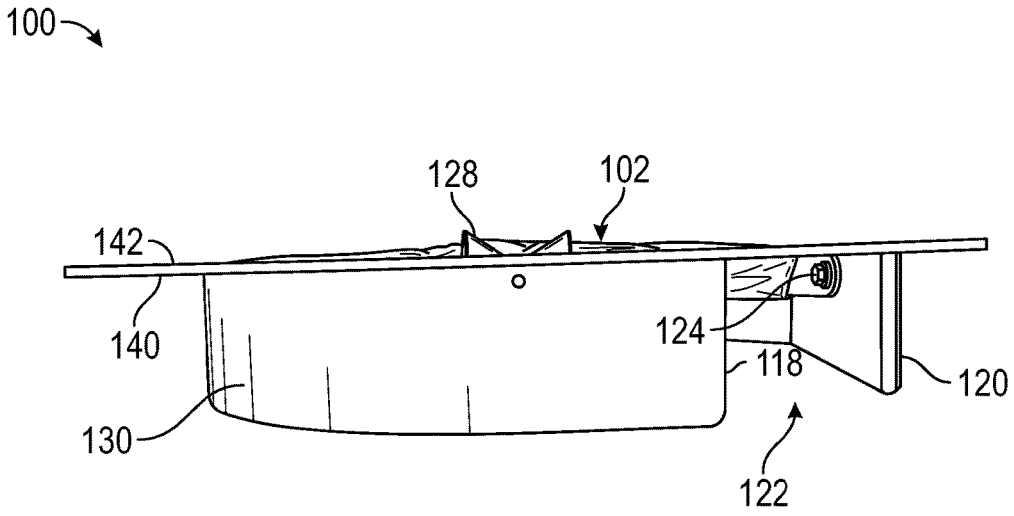
FIG. 8 is an enlarged view of the manhole cover safety apparatus showing a base and a flange that extends downward from the base.

As further shown in FIG. 4, one end of the first frame member 106 is in rotatable engagement along the inner surface 146 of the flange 130 at pivot point 124, while the opposite end of the first frame member 106 is in rotatable engagement along the inner surface 146 of the flange 130 at pivot point 126. Similarly, one end of the second frame member 108 is in rotatable engagement along the inner surface 146 of the flange 130 at pivot point 132, while the opposite end of the second frame member 108 is in rotatable engagement along the inner surface 146 at pivot point 133. The rotatable engagement of the first and second frame members 106 and 108 allows the cover portion 110 to be rotated between the deployed and retracted positions. In some embodiments, each of the pivot points 124, 126, 132 and 133 includes a respective rod that permits rotation of the first and second frame members 106 and 108 when the expandable cover 104 is being positioned between the deployed and retracted positions. In some embodiments, first and second cotter pins 138 and 140 may be used to retain the opposite ends of the first frame member 106 to the flange 130 of the circular base 102. The first frame member 106 may be disengaged from the circular base 102 by releasing the first and second cotter pins 138 and 140, respectively, from the pivot points 124 and 126. In some embodiments, additional cotter pins may be used to couple the second frame member 108 to pivot points 132 and 133.

Referring to FIGS. 1 and 3-7, in some embodiments the manhole cover safety apparatus 100 may include a roller 128 attached to the inner surface 146 of the flange 130. In some embodiments, the roller 128 may be rotatable and attached to the flange 130 through first and second extension members 134 and 136 that extend laterally inward from the flange 130. The roller 128 is configured to provide a rotatable conduit for running cables and wires through the manhole in an organized manner that prevents cables from becoming jumbled or interfere with the ingress or egress of individuals through the manhole cover safety apparatus 100.

In some embodiments, one method of using the manhole cover safety apparatus 100 includes removing a manhole cover (not shown) from the manhole 154 such that the manhole opening 156 is exposed and accessible. Once the manhole cover is removed, the flange 130 of the circular base 102 is inserted into the manhole opening 156 until the lower surface 144 of the circular base 102 abuts the peripheral area surrounding the manhole opening 156, thereby engaging the manhole cover safety apparatus 100 to the manhole 154. The cover portion 110 of the expandable cover 104 may then be placed in the deployed position to cover a portion of the manhole opening 156 when a visual warning is required that the manhole cover has been removed from the manhole 154. Conversely, when full access to the manhole opening 156 is required, the cover portion 110 may be placed in the retracted position. In addition, any cables and/or wires required to be inserted through the manhole opening 156 may be coupled to the roller 128 such that the any such cables and/or wires are inserted through the opening 116 of the circular base 102 in an organized manner. Once work in the manhole 154 is completed, the circular base 102 may be lifted upwardly and disengaged from the manhole opening 156.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A manhole cover safety apparatus comprising:

a circular base defining an inner circumferential edge forming a central opening, the circular base defining an upper surface and a lower surface;

a flange extending outwardly from the lower surface of the circular base;

an expandable cover attached to one portion of the circular base, the expandable cover comprising a cover portion engaged with a plurality of frame members which are in rotatable engagement with the circular base, wherein the expandable cover is operable between a deployed position wherein the cover portion is fully extended and covering at least a portion of the central opening and a retracted position wherein the cover portion is fully retracted and the central opening is uncovered.

2. The manhole cover safety apparatus of claim 1, wherein circular base defines an inner circumferential edge, and wherein the flange extends outwardly at a perpendicular angle from the inner circumferential edge relative to the circular base.

3. The manhole cover safety apparatus of claim 1, wherein the plurality of frame members comprises a first frame member and a second frame member in rotatable engagement with the flange of the circular base.

4. The manhole cover safety apparatus of claim 3, wherein at least one of the plurality of frame members is in rotatable engagement with the circular base through a rod and cotter pin arrangement.

5. The manhole cover safety apparatus of claim 1, further comprising:

a roller engaged to the flange and in communication with the central opening defined by the circular base.

6. The manhole cover safety apparatus of claim 5, wherein the roller is engaged to the flange through first and second extension members that extend inwardly from the flange, wherein the first and second extension members allow the roller to freely rotate.

7. The manhole cover safety apparatus of claim 1, wherein the cover portion defines a plurality of internal sleeves configured to receive a respective one of the plurality of frame members.

8. The manhole cover safety apparatus of claim 1, wherein the cover portion defines a first part that is secured to the circular base and a second part that forms a front edge of the cover portion.

9. The manhole cover safety apparatus of claim 8, wherein one of the plurality of frame members is secured to the second part of the cover portion.

10. The manhole cover safety apparatus of claim 9, wherein another one of the plurality of frame members is secured between the first and second parts of the cover portion.

11. The manhole cover safety apparatus of claim 1, wherein the circular base defines a first end portion and a second end portion that collectively define a slot that communicates with the central opening.

12. The manhole cover safety apparatus of claim 1, further comprising:

a handle operatively engaged to the expandable cover for positioning the expandable cover between the deployed position and the retracted position.

13. A method of using a manhole cover safety apparatus comprising:

removing a cover from a manhole opening of a manhole;

engaging a manhole cover safety apparatus to the periphery of the manhole opening, the manhole cover safety apparatus comprising:

a circular base defining an inner circumferential edge forming a central opening, the circular base defining an upper surface and a lower surface;

a flange extending outwardly from the lower surface of the circular base;

an expandable cover attached to one portion of the circular base, the expandable cover comprising a cover portion engaged with a plurality of frame members which are in rotatable engagement with the circular base, wherein the expandable cover is operable between a deployed position wherein the cover portion is fully extended and covering at least a portion of the central opening and a retracted position wherein the cover portion is fully retracted and the central opening is uncovered.

14. The method of claim 13, wherein the manhole cover safety apparatus further includes a roller configured to receive one or more cables being inserted through the central opening of the circular base in an organized manner.

15. The method of claim 13, further comprising:

positioning the expandable cover from a retracted position to the deployed position.

16. The method of claim 13, wherein the manhole cover safety apparatus further comprising:

a handle operatively engaged to the expandable cover, wherein actuating the handle in one direction causes the cover portion to be placed in the deployed position and actuating the handle in an opposite direction causes the cover portion to be placed in the retracted position.

* * * * *